US005570171A

United States Patent [19]

Kusumoto et al.

[11] Patent Number: 5,570,171

[45] Date of Patent: Oct. 29, 1996

[54] IMAGING FIXING DEVICE INCLUDING A HEAT ROLLER WITH A RELEASE LAYER

[75] Inventors: Yasuhiro Kusumoto, Nakai-Machi; Makoto Omata, Ebina; Yoshio Kanesawa; Yasuhiro Uehara, both of Nakai-machi; Toru Inoue, Ebina, all of Japan

[73] Assignee: Fuji Xerox Co., Ltd., Tokyo, Japan

[21] Appl. No.: 539,954

[22] Filed: Oct. 6, 1995

[30] Foreign Application Priority Data

Oct. 12, 1994 [JP] Japan ..... 6-246475

[51] Int. Cl.[6] ..... G03G 15/20

[52] U.S. Cl. ..... 355/285; 355/290

[58] Field of Search ..... 355/290, 284, 355/285; 219/216; 432/59, 60; 118/59, 60, 101

[56] References Cited

U.S. PATENT DOCUMENTS 4,914,484 4/1990 Kida ..... 355/290

5,481,349 1/1996 Satoh et al. ..... 355/290

5,485,259 1/1996 Uehara et al. ..... 355/284

*Primary Examiner*—Joan H. Pendegrass

*Assistant Examiner*—Quana Grainger

*Attorney, Agent, or Firm*—Oliff & Berridge

[57] ABSTRACT

An image fixing device is provided that includes a heat roller disposed rotatably, and a fixed way to apply pressure for contacting and applying pressure to the heat roller to form a nip portion. A recording sheet on which an unfixed toner image is formed passes through the image fixing device for fixing the toner image. The heat roller has a releasing layer on its surface for stripping the recording sheet which has passed through the nip portion, and $\mu_2$ and $\mu_2$ having the following relation $$\mu_1/\mu_2 \geqq 5,$$

wherein $\mu_1$ is a frictional coefficient between the releasing layer of the heat roller and the recording sheet and $\mu_2$ is a frictional coefficient between the surface of the pressure applying means and the recording sheet.

8 Claims, 2 Drawing Sheets

IMAGING FIXING DEVICE INCLUDING A HEAT ROLLER WITH A RELEASE LAYER

BACKGROUND OF THE INVENTION

1. Field of the Invention

The present invention relates to an image fixing device used in a machine employing an electrophotographic method such as a copying machine, a facsimile apparatus or a printer, and in particular relates to an image fixing device having a heat roller and fixed pressure means.

2. Discussion of the Related Art

In a copying machine and the like that utilizes an electrophotographic method, it is necessary to fix an unfixed toner image transferred on a recording sheet to form a permanent image. Therefore, fixing methods such as vapor fixing, cold pressure fixing and heat fusing have been conventionally used for permanent image formation. However, when the vapor fixing method is employed, a solvent vaporizes and diffuses, which causes an unpleasant odor. The cold pressure fixing method is inferior to other methods in fixing capability, and there is an economical problem such that the cold pressure fixing requires use of expensive pressure sensitive toner, for example, capsule toner. Both cold pressure fixing and vapor fixing are not widely used at present.

Accordingly, the heat fusing method, which melts the toner by heating and fixes it on the recording sheet, is widely employed in fixing an unfixed toner image. There are various types of heat fusing devices which bring the heat fusing method into practice. In particular, devices employing a heat roller method are generally used. As shown in FIG. 3, a device of such type comprises a heat roller 1, which is rotatably mounted, and a pressure roller 2. The heat roller 1 is made of a metal cylindrical core 3, a heater 4, such as an infrared ray lamp disposed inside of the metal cylindrical core 3, and a releasing layer 5 covering the peripheral surface of the metal cylindrical core 3. The releasing layer 5 is formed to prevent attachment of toner, which has transferred from the surface of the recording sheet, to the peripheral surface of the core 3 and is made of heat-resisting material such as fluororesin, silicone rubber or silicone resin.

The pressure roller 2 is disposed to contact the heat roller 1 and apply pressure thereto, and consists of a core 6 and a releasing layer 7, made of heat-resisting and elastic material, coating the peripheral surface of the core 6 to improve the paper stripping capability. As the heat-resisting and elastic material, for example, silicone rubber or fluororubber can be used. By rotating the heat roller 1 and pressure roller 2, a recording sheet 9 on which an unfixed toner image 8 is formed is passed through a nip area between the heat roller 1 and pressure roller 2, where the heat and pressure are applied to the recording sheet 9 to fix the toner image 8.

In comparison with other heat fusing methods, such as radiant fusing and oven fusing, the heat efficiency of the heat roller method is higher. Consequently, a smaller amount of electric power is consumed and high-speed fixing can be performed. Even if the recording sheets are jammed, the temperature is easily controlled so that the temperature of the recording sheet is not much higher than that of the heat roller. Accordingly, since there is little possibility of causing a fire, the heat roller method is moreover advantageous and is most widely used at present.

In general, to fix a toner image sufficiently, it is necessary to provide a nip width (the length of a portion where the heat roller 1 and the pressure roller 2 are in contact with each other in the direction of movement of the recording sheet 9) of, at least, about 4 mm. However, in the conventional image fixing device employing the heat roller method, since both heat roller 1 and pressure roller 2 are cylindrical, the diameters of heat roller 1 and pressure roller 2 must be large. As a result, the device as a whole necessarily becomes bulky and complex. Further, a problem occurs because the time required for raising the temperature of the device until fixing becomes practicable (hereinafter, referred to as warmup time) is inevitably long.

To overcome the above problems, image fixing devices using a fixed heat-resisting and elastic pressure applying member (pressure applying means)instead of the rotatable pressure roller 2 have been proposed (Japanese Patent Application Unexamined Publication No. Sho. 59-68766 (1984), Japanese Utility Model Application Unexamined Publication No. Sho. 60-8966 (1985), Japanese Utility Model Application Unexamined Publication No. Sho. 60-33362 (1985), Japanese Patent Application Unexamined Publication No. Sho. 62-135865 (1987), Japanese Utility Model Application Unexamined Publication No. Sho. 63-62862 (1988), Japanese Patent Application Unexamined Publication No. Sho. 50-134655 (1975), Japanese Patent Application Unexamined Publication No. Sho. 50-57444 (1975), Japanese Patent Application Unexamined Publication No. Sho. 61-11773 (1976), Japanese Utility Model Publication No. Hei. 4-52770 (1992) and Japanese Utility Model Application Unexamined Publication No. Sho. 63-62861 (1988)). In these devices, a portion of the surface of the heat-resisting and elastic pressure applying member contacting heat roller 1 is circular. Unlike the cylindrical pressure roller 2, the circular surface of the heat-resisting and elastic pressure applying member always contacts the heat roller 1. Therefore, the radius of curvature of the circular surface can be set regardless of the size of the heat-resisting and elastic pressure applying member, thus enabling miniaturization of the device.

In these devices, however, because the heat-resisting and elastic pressure applying member is fastened, it is hard for the end of the recording sheet 9 to enter the nip area, though the heat roller 1 is rotating. Even if entered, there are cases where the carrying speed of the recording sheet 9 is unstable. Further, a difference in carrying speed occurs in the longitudinal direction of the heat roller 1 (the direction of width of the recording sheet 9), which sometimes results in displacement of the recording sheet 9 in either side of the direction.

SUMMARY OF THE INVENTION

The present invention has been made in view of the above circumstances and has as an object, provision of an image fixing device which overcomes the problems described above.

Another object of the present invention is to provide an image fixing device with fastened pressure applying means which enables the smooth entry of the recording sheet into the nip area and the smooth movement of the recording sheet through the nip area.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims. To achieve the objects and in accordance with the purpose of the invention, as embodied and broadly described herein, an image fixing device of the present invention comprises a heat roller disposed rotatably, pressure applying means fixed for contacting and applying pressure to the heat roller to form a nip portion where a recording sheet, on which an unfixed toner image is formed, is passed for fixing the toner image. The heat roller has a releasing layer on its surface for stripping the recording sheet which has passed through the nip portion, and $\mu_1$ and $\mu_2$ having the following relation $$\mu_1/\mu_2 \geqq 5,$$

wherein $\mu_1$ is a frictional coefficient between the releasing layer of the heat roller and the recording sheet and $\mu_2$ is a frictional coefficient between the surface of the pressure applying means and the recording sheet.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENT

A preferred embodiment of an image fixing device according to the present invention is now described in detail based on the drawings.

Embodiment

Figure 1:
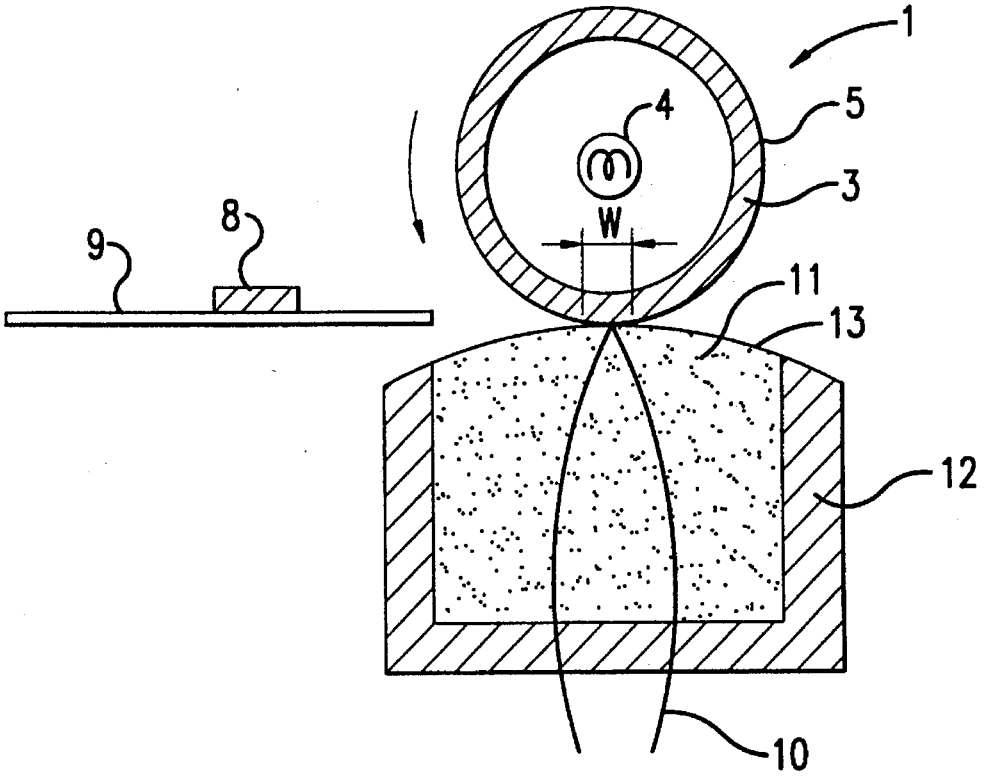
FIG. 1 is an elevational view in section showing construction of an embodiment of an image fixing device according to the present invention.
Figure 3:
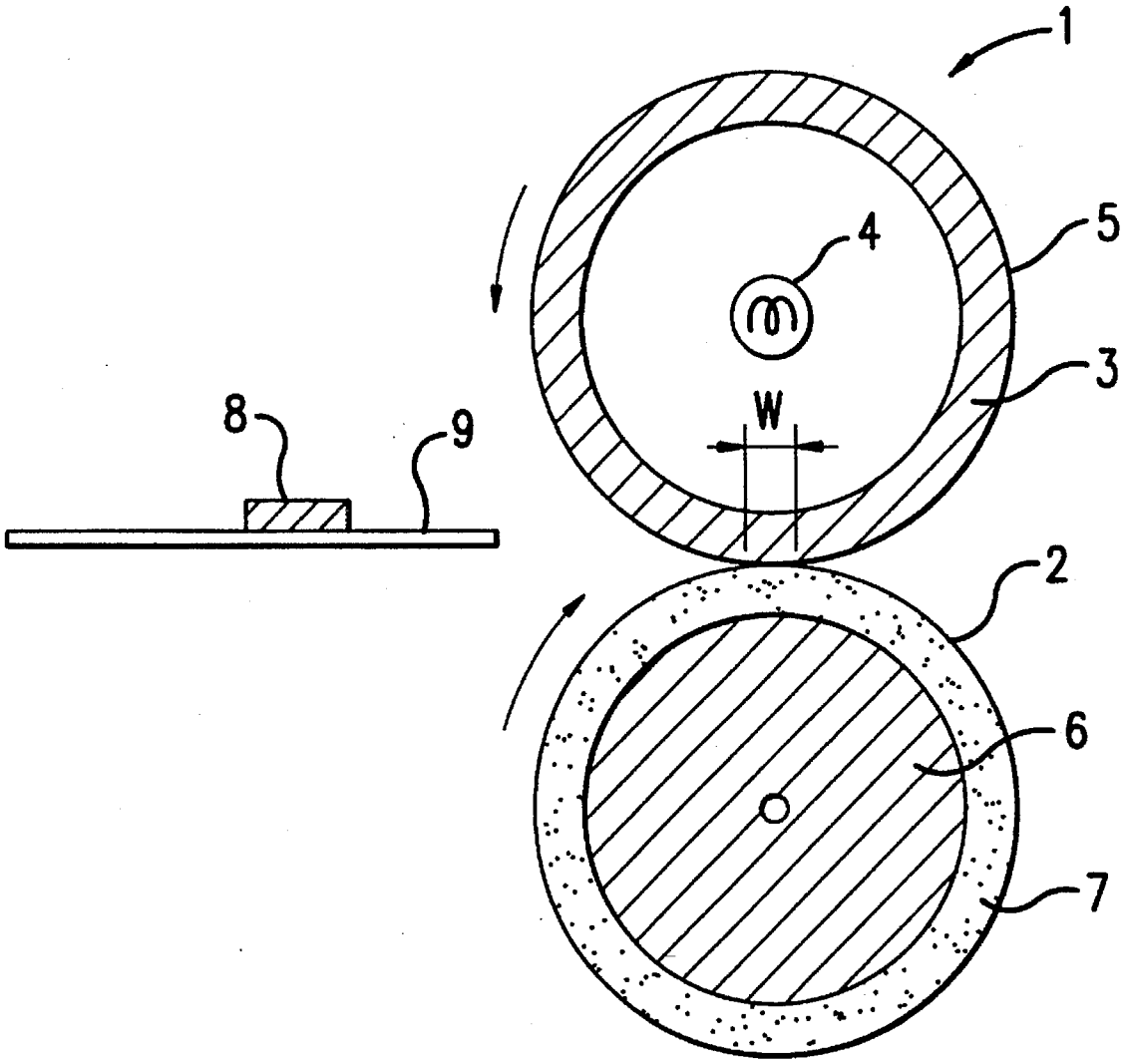
FIG. 3 is an elevational view in section showing construction of a conventional image fixing device.

In FIG. 1, constituents corresponding to constituents in FIG. 3 have the same reference numbers as those in FIG. 3 and explanations thereof are omitted. In this embodiment, as means for forming a nip area by contacting with a heat roller 1, a heat-resisting and elastic pressure applying member (pressure applying means) which is fastened is used. The upper surface of the heat-resisting and elastic pressure applying member 11, which contacts the heat roller 1, is curved to be circular. The heat-resisting and elastic pressure applying member 11 is held in a metal frame 12 to provide stable pressure necessary for fixing in the nip area.

A core 3 of the heat roller 1 is an iron cylinder, whose external diameter is 15 mm, thickness is 0.3 mm and length is 225 mm. A releasing layer 5 is made of silicone LTV (Low Temperature Vulcanization) rubber of 8 μm thickness. The hardness of the silicone rubber is measured with a durometer type A (spring type) manufactured by TECLOCK Corporation, in accordance with JIS-K 6301, by applying a load of 1,000 gf to a testpiece of silicone rubber having 20 mm thickness, which has been made in the same way as the coating material of the heat roller. As a result, the hardness of this silicone rubber is 25 duro (hardness of rubber described hereinafter is measured based on this method). The silicone LTV rubber is employed here, but it is not limited. For example, it is possible to use silicone HTV (High Temperature Vulcanization) rubber.

The heat roller 1 is manufactured by coating the surface of the core 3 with silicone primer as an adhesive, drying the primer while rotating the heat roller 1 in the normal temperature and then forming the releasing layer 5 on the surface of the heat roller 1. The releasing layer 5 material is a solution in which n-hexane dissolves unvulcanized silicone LTV rubber of 20 percent by weight. The releasing layer 5 is dried in a normal temperature during the rotation of the heat roller 1. Secondary vulcanization is carried out under a temperature of 200° C. for 4 hours to harden the releasing layer 5. Coating of primer and the releasing layer 5 is performed by a dip coating method in which the core 3 is dipped into each material solution while rotating. If a coating with uniform thickness can be achieved, other methods such as a spray method can be employed.

A heater 4 is a 100 V–300 W infrared ray lamp and is arranged so as to extend along the center axis of the core 3. The surface temperature of the heat roller 1 is measured at all times by a thermocouple 10 as a temperature sensor, and the heater 4 undergoes feedback control by a temperature controller not shown in the figure so that the heat roller 1 maintains the surface temperature at 150° C.

The heat-resisting and elastic pressure applying member 11 is made of silicone sponge (foamed silicone rubber). By applying a load of 300 gf, the hardness of the silicone sponge is measured with a sponge rubber hardness meter of ASKER C type manufactured by KOBUNSHI KEIKI Co., Ltd. As a result, the hardness of the silicone sponge is 35°±3°. The thickness of the heat-resisting and elastic pressure applying member 11 is 20 mm at the thickest portion, and the radius of curvature of the surface of that portion is 60 mm. The heat-resisting and elastic pressure applying member 11 is made of silicone sponge in this embodiment, but the material is not limited to this as long as it has appropriate hardness and durability. For example, silicone rubber may be used.

In a conventional image fixing device, radiuses of the heat roller and pressure roller are about 20 mm at most, and the nip width is limited to ⅕ of the diameter of the roller, that is, about 4 mm at most. To the contrary, the heat-resisting and elastic pressure applying member of the embodiment has large radius of curvature, though it is of small size. Therefore a nip area having a large width can be formed by the heat-resisting and elastic pressure applying member 11 and the heat roller 1. If a load of 8 kgf is applied to the heat roller 1 and the heat-resisting and elastic pressure applying member 11, the nip width of 6 mm can be obtained. Because the heat-resisting and elastic pressure applying member 11 is fastened, the quantity of heat release is smaller than that of the pressure roller. Moreover, since a uniform load is applied to the heat roller 11 in the axis direction, the thickness of the heat roller 11 can be smaller. For the reasons described above, the warmup time is reduced, and therefore quick start is made possible.

The inside of the silicone sponge constituting the heat-resisting and elastic pressure applying member 11 is impregnated with 100 g of dimethyl silicone oil having a viscosity of 10,000 cSt. This is a releasing agent that improves the paper stripping capability of the recording sheet 9 as it passes through the nip area. The upper surface of the heat-resisting and elastic pressure applying member 11 is covered with a releasing agent permeation control film 13 to supply the releasing agent in an appropriate amount to the nip area. As the releasing agent permeation control film 13, a film made of porous polytetrafluoroethylene (thickness is 20 μm, diameter of the pore is 0.1 μm–2.5 μm, and the porosity is 55%) is used. Under these conditions, the amount of the releasing agent supplied per one recording sheet of A4 size is 5.0 mg.

The releasing agent permeation control film 13 is not limited to the above, and other materials may be used as long as they can supply the releasing agent to the nip area appropriately and have small frictional coefficients. Other than the above-described film, for example, a film made of porous polytetrafluoroethylene whose thickness is 3–100 μm, diameter of the pore is 0.1–100 μm and the porosity is 30–95% ("Gore-Tex GT Sheet", a product name of Japan Gore-Tex Inc.), a fluororesin film of 5–500 μm thickness having pores of 50 μm–2.0 mm diameters or slits of 50 μm–2.0 mm widths, a sheet of paper, unwoven fabrics and compounds thereof can be used.

Next, operation of the embodiment of an image fixing device according to the present invention will be described. First, the recording sheet 9 on which an unfixed toner image 8 has been transferred is carried to the image fixing device by a transfer device not shown in the figure, and guided to the nip area between the heat roller 1 and the heat-resisting and elastic pressure applying member 11. The recording sheet 9 passes through the nip area by rotation of the heat roller 1.

Provided that the releasing agent is supplied under the above-described conditions and L-series plain paper of A4 size manufactured by Fuji Xerox Co., Ltd. is used as the recording sheet, a dynamic frictional coefficient $\mu_1$ between the heat roller 1 and the recording sheet 9 is 0.68, and a dynamic frictional coefficient $\mu_2$ between the heat-resisting and elastic pressure applying member 11 and the recording sheet 9 is 0.12. The frictional force between the heat roller 1 and the recording sheet 9 utilized to carry the recording sheet 9 is caused by the statical friction. However, it is extremely difficult to measure stability of the statical frictional coefficient. Accordingly, the dynamic frictional coefficient is measured as a substitute thereof. Here, the frictional coefficient $\mu_1$ is 5.7 times the frictional coefficient $\mu_2$. The frictional force, which the heat roller 1 receives from the recording sheet 9, is 5.4 kgf. This is a result of multiplying 8 kgf by 0.68. The frictional force that the heat-resisting and elastic pressure applying member 11 receives from the recording sheet 9 is 0.96 kgf, a result of multiplying 8 kgf by 0.12.

Under the above setting, as the heat roller 1 rotates, the recording sheet 9 enters the nip area without stagnation and smoothly passes through it. That is, problems such as difficulty in entering the edge of the recording sheet 9 in the nip area are never observed. Moreover, problems, such as unstable carrying speed of the recording sheet 9 or a difference arising in carrying speed in a longitudinal direction of the heat roller 1 (a direction of the width of the recording sheet 9), which causes displacement of the recording sheet 9 in that direction after the recording sheet 9 entered the nip area, do not occur. This may be attributed to the fact that the frictional force between the recording sheet 9 and the heat roller 1, which rotates for carrying the recording sheet 9, is much larger than the frictional force between the recording sheet 9 and the heat-resisting and elastic pressure applying member 11 which is fastened. Such an effect can be obtained if a relation between the frictional coefficients $\mu_1$ and $\mu_2$ expressed by the following inequality exists:

$$\mu_1/\mu_2 \geqq 5.$$

To confirm whether various types of recording sheets 9 can be smoothly carried in the same way as the L-series plain paper is carried when the above-described relation exists, an experiment has been made testing three kinds of paper having basis weight of 55, 64 and 76 g/m$^2$ and an OHP (overhead projector) sheet manufactured by Fuji Xerox Co., Ltd. A copying machine is used as the image formation apparatus in this experiment. The amount of dimethyl silicone oil supplied as the releasing agent is 2.0 mg per recording sheet of A4 size. At this time, the frictional coefficient $\mu_1$ between the heat roller 1 and the recording sheet is about 0.9, the frictional coefficient $\mu_2$ between the heat-resisting and elastic pressure applying member 11 and the recording sheet is about 0.15, and $\mu_1/\mu_2$ ranges from 6 to 8. Toner is attached to the whole surface of the recording sheet on which an image will be formed, and then the recording sheet passes through the nip area for fixing the toner. Here, the toner "Vivace 200 (a product name of Fuji Xerox Co., Ltd. )" manufactured by Fuji Xerox Co., Ltd. is used and the amount of attached toner is 0.6 mg/cm$^2$. The experiment showed that the three kinds of recording sheets and the OHP sheet smoothly enter the nip area and were carried.

Another experiment is carried out using a different material for the heat-resisting and elastic pressure applying member, whereby $\mu_1/\mu_2=4$. As a result, 3 sheets out of 100 sheets are not smoothly carried.

Moreover, as a comparative example, the material used in the releasing layer 5 formed on the surface of the heat roller 1 is changed to polytetrafluoroethylene ("Teflon", a product name of Du Pont de Nemours, El & CO) while other conditions are the same as those in the previous experiment. As a result, the carrying speed of the recording sheet becomes unstable or the recording sheet is displaced in the direction of width of the recording sheet, and the recording sheet does not enter the nip area. In the comparative experiment, the frictional coefficient $\mu_1$ between the heat roller 1 and the recording sheet ranges from 0.1 to 0.2; therefore $\mu_1/\mu_2$ ranges from 1 to 2. The table 1 below shows the results of these experiments, wherein "*" means that the recording sheet can enter the nip area and the carrying speed is stable, "" means that the recording sheet can enter the nip area, but the carrying speed is unstable, and "*" means that the recording sheet cannot enter the nip area. As it can be seen from Table 1, in the comparative experiment, capability for carrying the recording sheet is deteriorated.

TABLE 1

| Surface Material of Heat Roller | (Paper) 55 g/m$^2$ | (Paper) 64 g/m$^2$ | (Paper) 76 g/m$^2$ | OHP Sheet |
|---|---|---|---|---|
| Silicone LTV Rubber | * | * | * | * |
| Polytetra-fluoroethylene | *** | *** | ** | *** |

Next, the above-described experiment is carried out again using the heat roller 1 having the releasing layer 5 made of silicone LTV rubber. After image fixing is performed for about 2,000 recording sheets with longitudinal feeding, self-stripping of the recording sheets becomes impracticable. Here, longitudinal feeding means carry the recording sheets in the direction parallel to that of the fiber orientation of the recording sheets, and the recording sheet has a self-stripping capability for stripping itself from the heat roller 1 without using stripping means such as a stripper finger. If the toner forming the image melts and adheres to the heat roller 1, the recording sheets cannot perform self-stripping. The surface of the heat roller 1 is observed at this time, and the releasing layer 5 is found to be worn down.

To reduce wear, the releasing layer 5 of 8 μm thickness with higher hardness is formed by adding iron oxide ($FeO_3$) to the silicone rubber. Successive image formation (copying) over a large volume is carried out under the same conditions as those of the previous experiment except that a heat roller 1 having the releasing layer 5 of higher hardness is employed. Table 2 below shows the result of this experiment.

TABLE 2

| Number of Sheets of Successive Copying | Rubber Hardness (duro) | | | | | | | | | | | | | | |
|---|---|---|---|---|---|---|---|---|---|---|---|---|---|---|---|
| | 25 | | | 30 | | | 40 | | | 50 | | | 60 | | |
| | A | B | C | A | B | C | A | B | C | A | B | C | A | B | C |
| 500 | * | * | * | * | * | * | * | * | * | * | * | * | * | * | * |
| 1000 | * | * | * | * | * | * | * | * | * | * | * | * | * | * | * |
| 2000 | ** | * | ** | * | * | * | * | * | * | * | * | * | * | * | * |
| 3000 | | | | * | * | * | * | * | * | * | * | * | * | * | * |
| 5000 | | | | * | * | * | * | * | * | * | * | * | ** | * | ** |
| 7000 | | | | ** | * | ** | * | * | * | ** | * | ** | | | |
| 10000 | | | | | | | ** | ** | ** | | | | | | |

A: Releasing Capability
B: Sheet Carrying Capability and Easiness in Entering Nip Area
C: Image Quality In the Table 2, Releasing Capability means capability for self-stripping described above, Sheet Carrying Capability means capability for carrying the recording sheet with a stable speed and without causing displacement in the direction of the width of the recording sheet, and Easiness in Entering Nip Area means easiness for the recording sheet to enter the nip area. If the releasing layer 5 is worn down, any of above capabilities, including image quality, cannot be good. In the table, "*" indicates that the capability is satisfactory, and "" indicates that the capability is unsatisfactory. As it can be understood from Table 2, as hardness of the releasing layer 5 increases, the durability of the releasing layer 5 improves. If the preferable copying volume is assumed to be 5,000 sheets, the releasing layer 5**, which has preferable releasing capability and image quality has a hardness of 30 duro at least. That is, it is preferable that the hardness of silicone rubber is at least 30 duro.

However, if the hardness is more than 60 duro, releasing capability and image quality is deteriorated when the number of copied sheets amounts to 5,000. It is generally known that releasing capability is deteriorated by adding iron oxide to the releasing layer 5. Thus the result of this experiment can be considered to be deterioration of the releasing capability under the influence of iron oxide as the additives, which is accompanied by deterioration of image quality.

Figure 2:
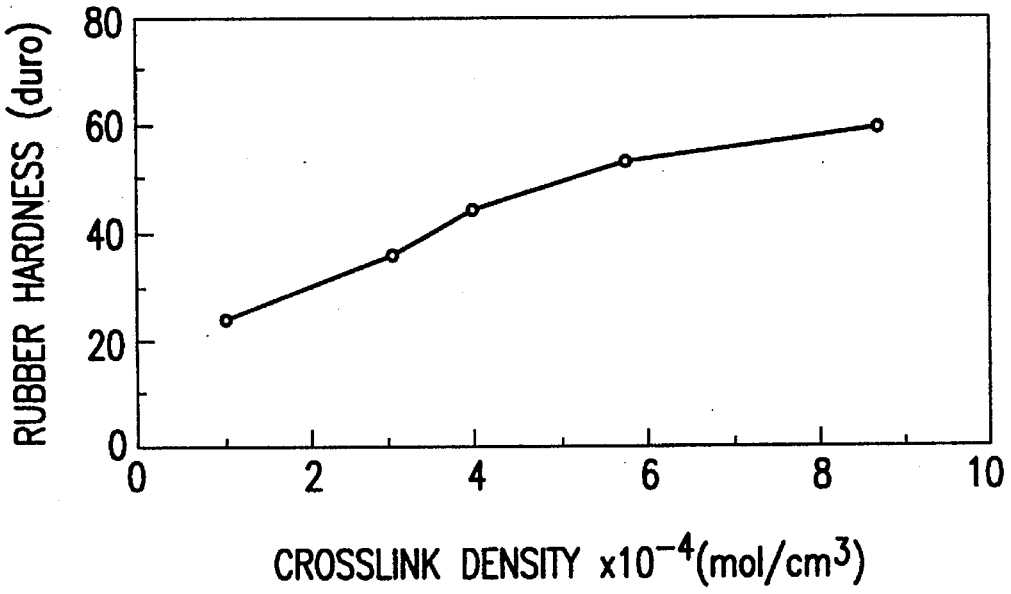
FIG. 2 is a graph showing the relation between crosslink density and hardness of silicone rubber used as a releasing layer of a heat roller in the embodiment of the image fixing device according to the present invention.

The inventors of this invention has discovered that it is better to increase the hardness of the silicone rubber by increasing the crosslink density of silicone rubber itself, not by using additives. As shown in a graph in FIG. 2, if the crosslink density becomes higher, the hardness is also increased. With the heat roller 1 having the releasing layer 5 made of silicone rubber of higher crosslink density, an experiment is carried out in the same way as the previous experiment. Table 3 shows the result of the experiment.

TABLE 3

| Number of Sheets of Successive Copying | Rubber Hardness (duro) | | | | | | | | | | | | | | |
|---|---|---|---|---|---|---|---|---|---|---|---|---|---|---|---|
| | 25 | | | 30 | | | 40 | | | 50 | | | 60 | | |
| | A | B | C | A | B | C | A | B | C | A | B | C | A | B | C |
| 500 | * | * | * | * | * | * | * | * | * | * | * | * | * | * | * |
| 1000 | * | * | * | * | * | * | * | * | * | * | * | * | * | * | * |
| 2000 | * | * | * | * | * | * | * | * | * | * | * | * | * | * | * |
| 3000 | * | * | * | * | * | * | * | * | * | * | * | * | * | * | * |
| 5000 | ** | * | ** | * | * | * | * | * | * | * | * | * | * | * | * |
| 7000 | | | | * | * | * | * | * | * | * | * | * | * | * | * |
| 10000 | | | | * | * | * | * | * | * | * | * | * | * | * | * |
| 15000 | | | | ** | * | ** | * | * | * | * | * | * | * | * | * |
| 20000 | | | | | | | ** | * | ** | * | * | * | * | * | * |
| 25000 | | | | | | | | | | * | * | * | * | * | * |
| 30000 | | | | | | | | | | ** | * | ** | * | * | * |
| 40000 | | | | | | | | | | | | | ** | * | ** |

A: Releasing Capability
B: Sheet Carrying Capability and Easiness in Entering Nip Area
C: Image Quality As it can be seen from Table 3, the use of silicone rubber whose hardness becomes higher by increasing the crosslink density, not by depending upon additives, can make the life of the releasing layer 5 longer than in the case where silicone rubber whose hardness is increased by adding iron oxide, which is used to form the releasing layer 5 in the previous experiment, the result of which is shown in Table 2. Moreover, within a range that the hardness of silicone rubber is 60 duro or less, the more the hardness of silicone rubber increases, the more the durability of the releasing layer 5 is improved. Here, if it is assumed that preferable copying volume is 5,000 sheets, hardness of the releasing layer 5 which enables image fixing for more than 5,000 recording sheets with good releasing capability and image quality is 30 duro or more. Further, if the desirable number of copying volume is assumed to be 10,000, it can be seen from Table 3 that the preferable hardness of silicone rubber is 30 duro or more. In the graph in FIG. 2, the crosslink density of silicone rubber corresponding to the hardness of 30 duro or more is $2\times10^{-4}$ (mol/cm$^3$) or more. Accordingly, this is the desirable value of the crosslink density.

Furthermore, if the desirable copying volume is increased to 15,000 sheets or more, the hardness of the releasing layer 5, which enables image fixing for 15,000 recording sheets with good releasing capability and image quality, is 40 duro or more. The value of the crosslink density of silicone rubber corresponding to the hardness of 40 duro or more is $3\times10^{-4}$ (mol/cm$^3$). Therefore this is the desirable value of the crosslink density of silicone rubber.

As described above, in the case where the hardness of silicone rubber, which is the material of the releasing layer 5, is to be increased not by adding iron oxide, the preferable hardness of the releasing layer 5 is 30 duro or more and the preferable crosslink density is $2\times10^{-4}$ (mol/cm$^3$) or more. To be more desirable, the hardness is 40 duro or more and the crosslink density is $3\times10^{-4}$ (mol/cm$^3$) or more. By adopting these values, wearing of the releasing layer 5 can be prevented. Moreover, not only the recording sheet carrying capability and easiness in entering nip area, but also releasing capability and image quality can be maintained satisfactorily even with large volume image formation.

In addition, to maintain the recording sheet carrying capability, easiness in entering nip area, releasing capability and image quality for a long time, it is necessary to consider the thickness of the releasing layer 5 as well as to harden the releasing layer 5 for reducing wearing of the releasing layer 5. The thickness of the releasing layer 5 has been 8 μm in the previous experiments. Here, successive copying is performed with variation in thickness of the releasing layer 5: 5, 8, 10 and 20 μm. Table 4 shows the relation between thickness of the releasing layer 5 of silicone rubber whose hardness is made to be 40 duro by increasing the crosslink density and the durability of the releasing layer 5.

TABLE 4

| Number of Sheets | Thickness of Releasing Layer 5 (μm) | | | | | | | | | | | |
|---|---|---|---|---|---|---|---|---|---|---|---|---|
| of Successive | 5 | | | 8 | | | 10 | | | 20 | | |
| Copying | A | B | C | A | B | C | A | B | C | A | B | C |
| 500 | * | * | * | * | * | * | * | * | * | * | * | * |
| 2000 | * | * | * | * | * | * | * | * | * | * | * | * |
| 5000 | * | * | * | * | * | * | * | * | * | * | * | * |
| 10000 | * | * | * | * | * | * | * | * | * | * | * | * |
| 5000 | ** | * | ** | * | * | * | * | * | * | * | * | * |
| 20000 | | | | ** | * | ** | * | * | * | * | * | * |

TABLE 4-continued

| Number of Sheets | Thickness of Releasing Layer 5 (μm) | | | | | | | | | | | |
|---|---|---|---|---|---|---|---|---|---|---|---|---|
| of Successive | 5 | | | 8 | | | 10 | | | 20 | | |
| Copying | A | B | C | A | B | C | A | B | C | A | B | C |
| 25000 | | | | | | | * | * | * | * | * | * |
| 30000 | | | | | | | * | * | * | * | * | * |
| 35000 | | | | | | | * | * | * | * | * | * |
| 40000 | | | | | | | * | * | * | * | * | * |
| 45000 | | | | | | | ** | * | ** | * | * | * |
| 50000 | | | | | | | | | | * | * | * |

A: Releasing Capability
B: Sheet Carrying Capability and Easiness in Entering Nip Area
C: Image Quality As it is clear from Table 4, copying capability, evaluated by the number of processed recording sheets, increases as the thickness of the releasing layer 5 increases while maintaining the recording sheet carrying capability, ease in entering nip area, releasing capability and image quality. Thus, the life of the releasing layer 5 is prolonged. Moreover, by increasing the thickness from 8 μm to 10 μm, great elongation of the life of the releasing layer 5 can be observed. Such tendency can be seen not only in the case the hardness of the releasing layer 5 is 40 duro, but also in the cases where the hardness of the releasing layer 5 is 30, 50, and 60 duro. Therefore, it is preferable that the thickness of the releasing layer 5 made of silicone rubber is at least 10 μm.

As described so far, according to one aspect of an image fixing device related to the present invention, by making the frictional coefficient $\mu_1$ between the surface of the heat roller and the recording sheet sufficiently higher than the frictional coefficient $\mu_2$ between the surface of the pressure roller and the recording sheet, the recording sheet can be carried by overcoming the frictional force between the pressure roller and the recording sheet accompanied with the rotation of the heat roller. Thereby the recording sheet smoothly enters the nip area and is smoothly carried after entering. Consequently, problems such as unstable recording sheet carrying speed or the recording sheet is displaced in the direction of the width of the recording sheet while being carried, can be prevented.

According to another aspect of the present invention, the life of the releasing layer can be prolonged, and good and stable recording sheet carrying capability, ease in entering the nip area, releasing capability and image quality are maintained for a long time. In this case, if the hardness of the silicone rubber, which is the material of the releasing layer, is made higher by increasing the crosslink density of silicone rubber, the life of the releasing layer can be longer than that of the releasing layer whose hardness is increased by adding iron oxide. The more the hardness increases, the more the durability of the releasing layer is improved. Therefore it is easy to set an appropriate hardness of the silicone rubber corresponding to length of required life of the releasing layer. It is also possible to elongate the life of the releasing layer.

The foregoing description of preferred embodiment of this invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image fixing device comprising:

a heat roller disposed rotatably;

pressure applying means fixed for contacting and applying pressure to said heat roller to form a nip portion where a recording sheet on which an unfixed toner image is formed is passed for fixing said toner image;

said heat roller having a releasing layer on its surface for stripping said recording sheet which has passed through said nip potion; and $\mu_1$ and $\mu_2$ having the following relation $$\mu_1/\mu_2 \geqq 5,$$

wherein $\mu_1$ is a frictional coefficient between said releasing layer of said heat roller and said recording sheet and $\mu_2$ is a frictional coefficient between the surface of said pressure applying means and said recording sheet wherein said releasing layer of said heat roller is made of silicone rubber having at least $2\times10^{-4}$ (mol/cm$^3$) crosslink density.

2. The image fixing device according to claim 1, wherein said releasing layer of said heat roller is made of silicone rubber having at least 30 duro hardness measured with a durometer type A (spring type) in accordance with JIS-K 6301.

3. The image fixing device according to claim 2, wherein thickness of said releasing layer of said heat roller is at least 10 μm.

4. The image fixing device according to claim 1, wherein thickness of said releasing layer of said heat roller is at least 10 μm.

5. An image fixing device comprising:

a pressure applying means having an elastic pressure applying member impregnating a releasing agent;

a heat roller having a releasing layer on its surface for stripping said recording sheet and being contacted and applied pressure by said elastic pressure applying member;

said heat roller carrying said recording sheet on which an unfixed toner image is formed opposed to resistance generated by said elastic pressure applying member;

said releasing layer of said heat roller being made of silicone rubber which has wettability for said releasing agent impregnated in said elastic pressure applying member of said pressure applying means; and $\mu_1$ and $\mu_2$ having the following relation $$\mu_1/\mu_2 \geqq 5,$$

wherein $\mu_1$ is a frictional coefficient between said releasing layer of said heat roller and said recording sheet and $\mu_2$ is a frictional coefficient between said elastic pressure applying member and said recording sheet wherein said releasing layer of said heat roller is made of silicone rubber having at least $2\times10^{-4}$ (mol/cm$^3$) crosslink density.

6. The image fixing device according to claim 5, wherein said releasing layer of said heat roller is made of silicone rubber having at least 30 duro hardness measured with a durometer type A (spring type) in accordance with JIS-K 6301.

7. The image fixing device according to claim 6, wherein a thickness of said releasing layer of said heat roller is at least 10 microns.

8. The image fixing device according to claim 5, wherein a thickness of said releasing layer of said heat roller is at least 10 microns.

* * * * *